US007527164B1

(12) United States Patent
Reichborn

(10) Patent No.: US 7,527,164 B1
(45) Date of Patent: May 5, 2009

(54) TRAY FOR PAINT CAN, BRUSH AND RAG

(76) Inventor: Per K Reichborn, 99 Lower Cross Rd., Greenwich, CT (US) 06831

( * ) Notice: Subject to any disclaimer, the term of this patent is extended or adjusted under 35 U.S.C. 154(b) by 0 days.

(21) Appl. No.: 12/009,797

(22) Filed: Jan. 22, 2008

Related U.S. Application Data

(63) Continuation-in-part of application No. 11/088,335, filed on Mar. 24, 2005, now abandoned.

(51) Int. Cl.
*B65D 21/032* (2006.01)

(52) U.S. Cl. ..... 220/571.1; 220/570

(58) Field of Classification Search ..... None
See application file for complete search history.

(56) References Cited

U.S. PATENT DOCUMENTS

| | | | |
|---|---|---|---|
| 807,548 | A | 12/1905 | Ganswindt |
| 864,556 | A | 8/1907 | Reiter |
| 2,150,965 | A | 3/1939 | Doty |
| 2,550,713 | A | 5/1951 | Nicholson |
| 2,856,095 | A | 10/1958 | Schnabel |
| 3,352,450 | A | 11/1967 | Rawlins |
| 3,407,429 | A | 10/1968 | Di Nardo |
| 3,491,976 | A | 1/1970 | Larson |
| 3,997,072 | A | 12/1976 | Guth |
| 4,071,163 | A | 1/1978 | Martin |
| 4,722,442 | A | 2/1988 | Smith |
| 4,998,696 | A | 3/1991 | Desjardins |
| D340,761 | S | 10/1993 | Long |
| D474,404 | S | 5/2003 | Tropeano |

*Primary Examiner*—Stephen Castellano
(74) *Attorney, Agent, or Firm*—Patrick J. Walsh

(57) ABSTRACT

A paint can and paint brush holder in the form of a tray having means for securing the can to the tray, means to facilitate holding the tray and paint can with one hand as the other hand applies paint from an open can with a brush, the tray having place for setting down one or more wet brushes, and for holding a wipe-up rag.

12 Claims, 9 Drawing Sheets

TRAY FOR PAINT CAN, BRUSH AND RAG

PRIOR APPLICATION

This application is a continuation-in-part of my application Ser. No. 11/088,335 filed Mar. 24, 2005 now abandoned.

BACKGROUND OF THE INVENTION

The present invention is directed to a device for holding a paint can, wet paint brush, and clean-up rag.

Paint dripping presents a constant hazard during the course of painting using a brush for applying paint from an open can. Paint dripping often occurs after opening a paint can and stirring the paint, pouring a portion of paint from the can, and while applying the paint with a brush. In addition, it is often necessary or desirable to set down a wet brush while a painter attends to another task related to a paint job. In practice it is necessary to protect adjacent surfaces and flooring with drop cloths, newspapers and so forth to avoid adverse effects of paint dripping particularly inadvertent drips which are likely to dry before being noticed. The time required to complete a paint job increases significantly when preparatory steps are needed for covering such adjacent surfaces.

For paint jobs requiring a smaller quantity of paint, for example, where quart size or smaller containers are used there are the addition problems of container stability and mobility. Such containers do not have a bail and must be gripped by hand for placing the can in suitable position for painting. Also due care is needed to prevent upsetting the can during use.

Inevitably, while painting unwanted paint spots occur from paint drips or from inadvertent brush dabs that require immediate attention with a wipe-up rag to maintain a neat and orderly job site.

There is need for a paint can and brush holder that contains dripping of paint from the can, provides for stability, mobility and ease of handling of a paint can in use, provides a place for setting down a wet brush all in the course of a paint job, and keeps a wipe-up rag at hand.

SUMMARY OF THE INVENTION

The present invention provides a paint can and brush holder for ease of handling a paint can particularly cans smaller than a gallon in volume. The holder according to the invention comprises a tray with a planar base and inclined sidewall, with means for engaging the base portion of a can for securing the can in place in the tray. The sidewall includes an aperture for accommodating the thumb so as to hold the tray with paint can in one hand while painting with the other. In this way the can may be held by one hand in close proximity to a work site while the other applies paint with a brush in a manner that confines paint drips to the tray including drips from the can and those that might fall from the brush.

The paint can holder has an integral compartment for setting down one or more wet brushes as necessary from time to time during a paint job.

The holder includes mean for retaining a can in place in the tray in the form of upstanding tabs including fixed tabs and releasable tabs that engage a can bottom rim.

The holder also provides for keeping a wipe-up rag close at hand for cleaning inadvertent paint drips and dabs that are best dealt with immediately.

The paint can holder according to the invention is fabricated from any suitable material and is preferably fabricated of molded plastic.

Specific examples are included in the following description for purposes of clarity, but various details can be changed within the scope of the present invention.

OBJECTS OF THE INVENTION

An object of the invention is to provide a paint can and brush holder for facilitating application of paint while minimizing the hazard of paint drips and spills that occur in the course of applying paint.

Another object of the invention is to provide a paint can holder that may be held in one hand while the other brushes paint at a work site.

Another object of the invention is to provide a paint can holder that has provision of setting down one or more wet brushes.

Another object is to provide a can and brush holder which also keeps a wipe-up rag handy.

Another object of the invention is to provide a paint can holder that has fixed and releasable tabs for retaining a can in place in the tray.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
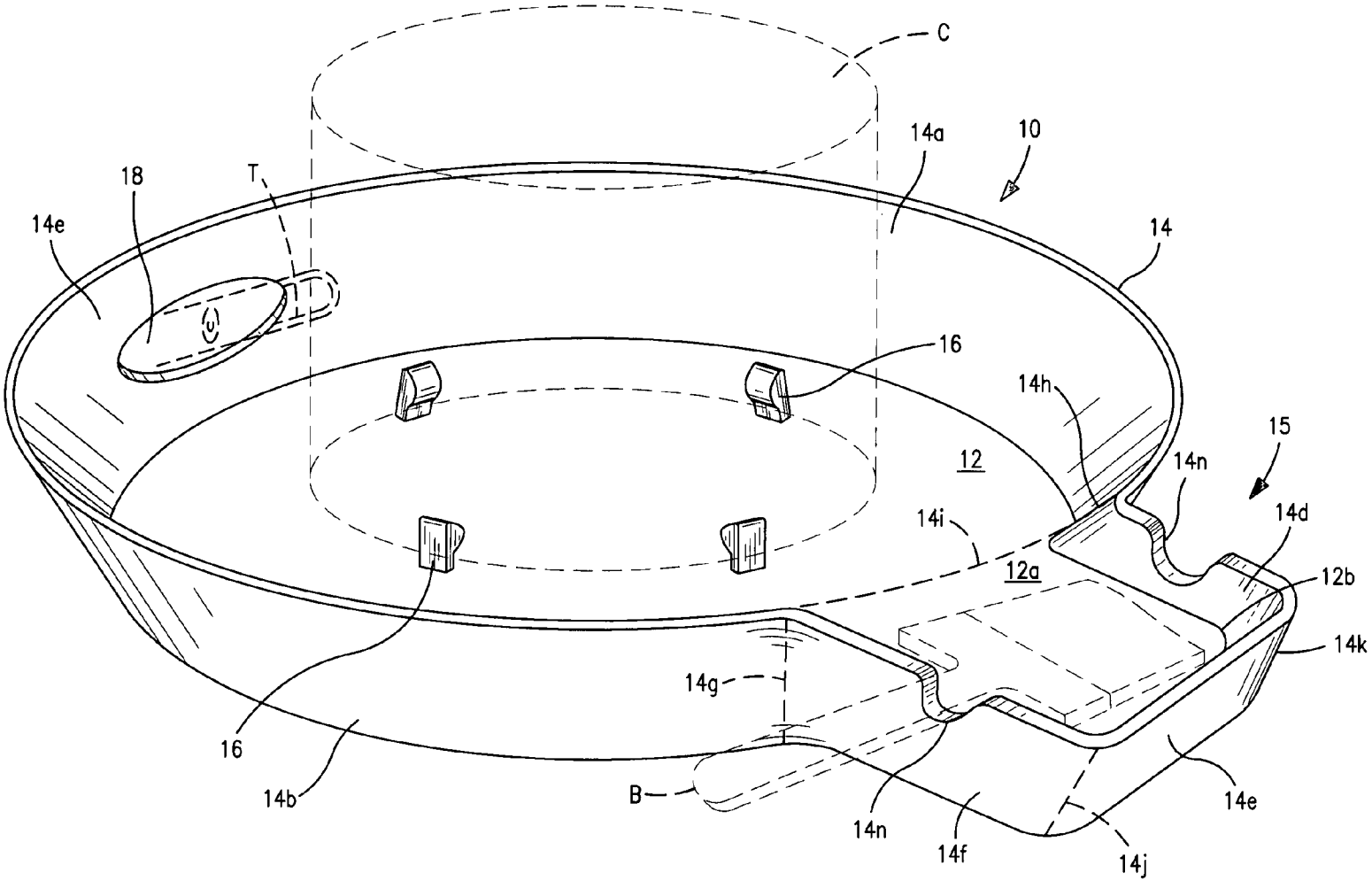
FIG. 1 is a perspective view of a paint can and brush holder according to the invention.

Referring to FIG. 1 of the drawing, a paint can and brush holder according to the invention comprises a tray 10 having a planar base panel 12 and upwardly and outwardly inclined sidewall 14 having first sections 14*a-b-c* situated around paint can C. The tray further includes an integral brush compartment 15 defined by a base extension 12*a* and by second sidewall sections 14*d*, 14*e* and 14*f* extending upward from the margin 12*b* of base extension 12*a*.

As shown in FIG. 1 sidewall 14 extends in a circle from its junction 14*g* with sidewall section 14*f* to its junction 14*h* with sidewall section 14*d* leaving a gap 14*i* in sidewall 14 of about 30° to 90° of the sidewall circle between sidewall junctions 14*g-h*.

Second sidewall portions 14*d* and 14*f* each extend outwardly from sidewall 14 beginning at inner junctions 14*g-h* respectively in generally parallel relation to each other, terminating at outer junctions 14*j-k* where they each join opposite ends of sidewall section 14*e* at right angles.

In similar manner, the planar tray base panel extends through the gap 14*i* to define a brush base extension 12*a* joined at margin 12*c* to adjacent margins of sidewall portions 14*d-e-f*.

Both peripheral sidewall sections 14*d* and 14*f* are provided with at least one notch 14*n* for receiving the handle of a brush B placed in the brush compartment. It is to be understood that a second notch may be located next to notch 14*n* to accommodate a second preferably smaller brush used for detailing particular aspects of a paint site, as shown in the modified embodiment of FIG. 5. It is further understood that the notches can be formed in any one of the peripheral sidewall sections 14*d-f*.

In this way, base extension 12*a* and second sidewall portions 14*d-e-f* define a brush compartment apart from tray base 12 now restricted to accommodating a paint can. As shown in FIG. 1, a brush B may be placed in the brush compartment to lie flat in a stable manner without touching and dabbing the can with paint.

Figure 2:
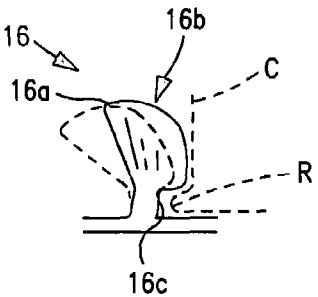
FIG. 2 is a detail view in side elevation of a component of the holder of FIG. 1.

The base of the tray is fitted with a plurality, preferably four, upstanding spring fingers 16 arranged in a circle for engaging the bottom rim of a paint can for holding the can securely against the base. The spring fingers are formed integral with the base. The spring fingers (FIG. 2) have an upright body 16*a* with an inwardly directed cam face 16*b* terminating in a base recess 16*c*. As shown in FIG. 2, in use the spring fingers yield (dash lines) as a paint can C is fitted onto the tray and spring back to the position of FIG. 2 with spring recesses 16*c* engaging the can base rim R so as to secure the can on the tray.

The sidewall 14 of the holder includes an aperture 18 (FIG. 1) for holding the tray in one hand with the thumb T extending through the aperture and the remaining fingers engaging the underside of the base. The other hand is free to brush paint onto a work site. In this way paint drips from either the paint can or paint brush are confined to the tray, and the tray may be positioned conveniently close to a work site so as to minimize the possibility of paint dripping from a wet brush as the brush moves from paint can to work site.

Preferably the aperture 18 is positioned in the sidewall at a location diametrically opposite the brush compartment 15 for optimum cooperation of hands and holder in use of the invention.

Figure 3:
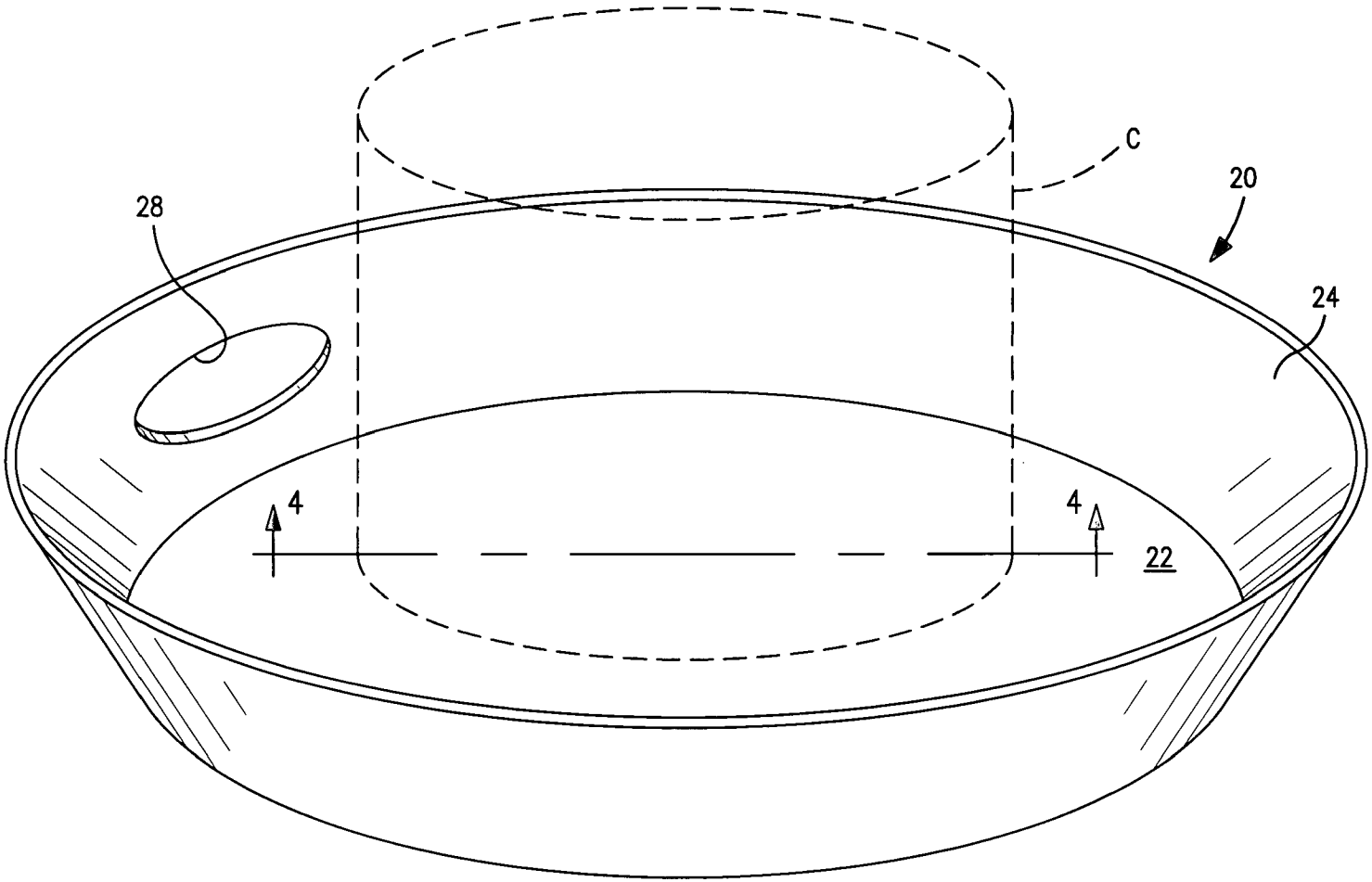
FIG. 3 is a perspective view of a modified embodiment of the invention.

A modified embodiment of the invention is shown in FIG. 3 and comprises a tray 20 having a planar base 22 and upwardly and outwardly inclined sidewall 24.

Figure 4:
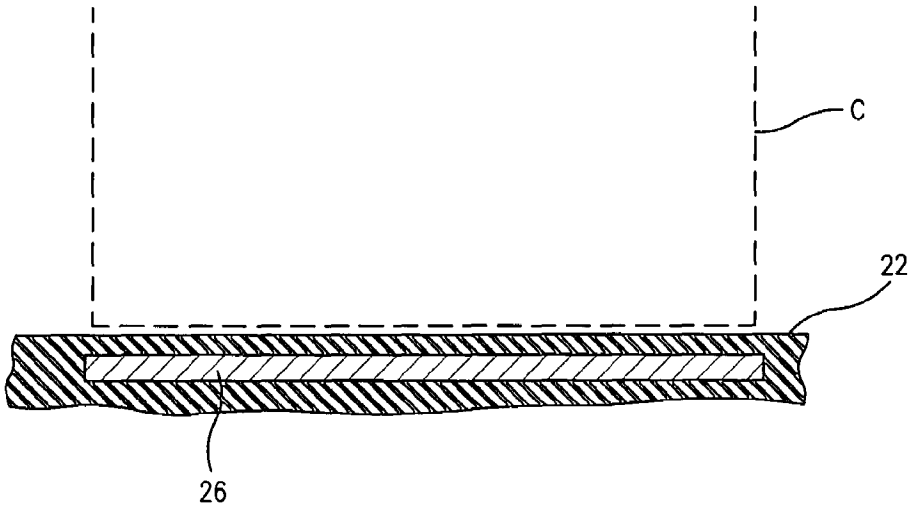
FIG. 4 is a section view taken along line 4-4 of FIG. 3.

The base of the tray is fitted with a magnetic plate 26 (FIG. 4) embedded in the base of the holder for securing a paint can C in place on the holder. The magnetic plate is embedded in the base as an aspect of the molding technique used in manufacturing the holder.

The sidewall of the holder includes an aperture 28 for holding the tray in one hand with the thumb extending through the aperture and the remaining fingers engaging the underside of the base.

Figure 5:
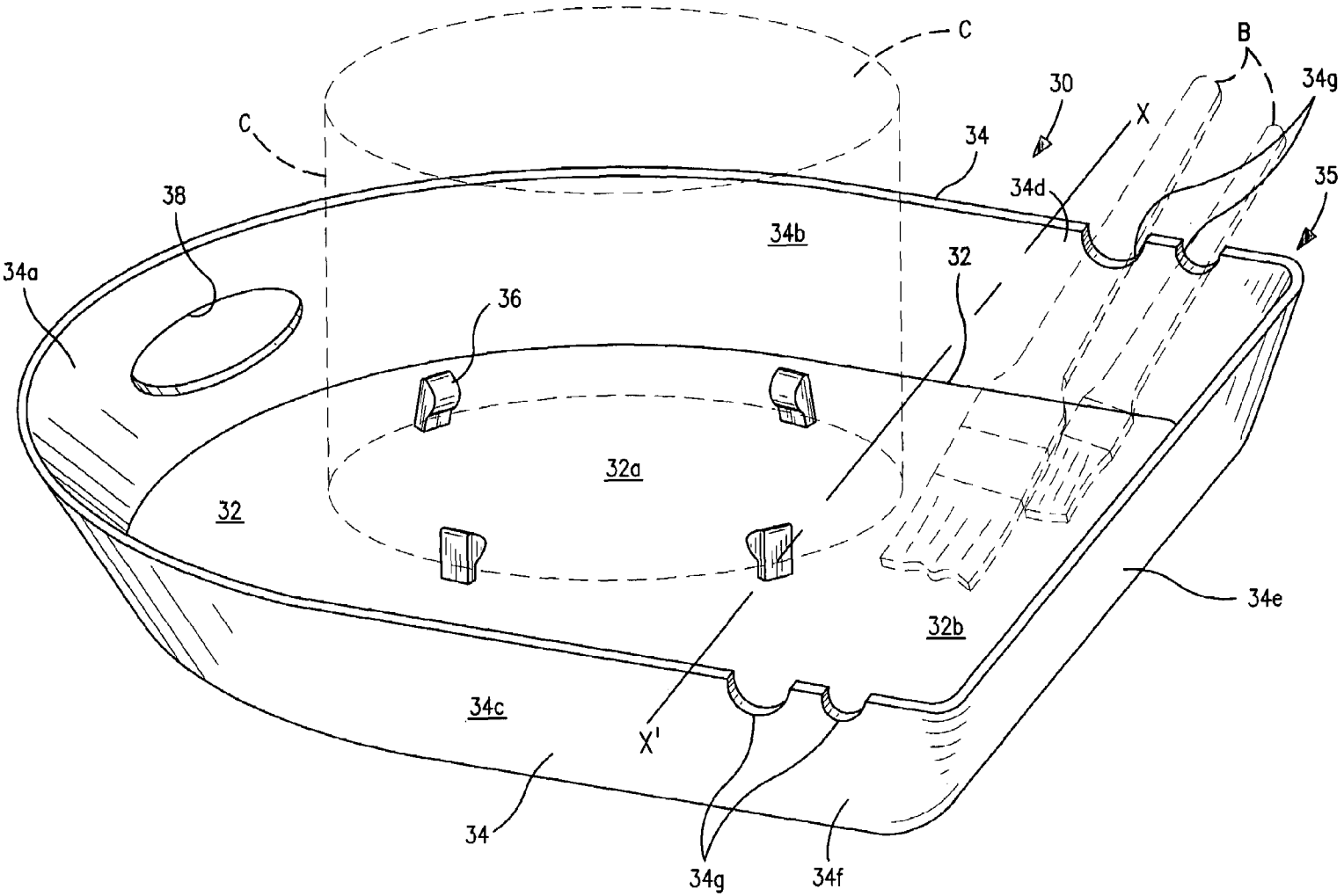
FIG. 5 is a perspective view of another modified embodiment of the invention.

Another modified embodiment of the invention is shown in FIG. 5 and comprises a tray 30 having a planar base 32 and upwardly and outwardly inclined sidewall 34.

Tray 30 comprises a paint can compartment defined by sidewall 34 joined to base 32 with the sidewall encircling a paint can with curved sidewall 34*a* at one end and straight sidewall sections 34*b-e* on opposite sides and end of the tray. The base 32 is integral with the entire sidewall along base margin 32*c*, and together base and sidewall provide a stable structure for supporting a full paint can.

The base of the tray in the paint compartment is fitted with a plurality, preferably four, upstanding spring fingers 36 arranged in a circle for engaging the bottom rim of a paint can for holding the can securely against the base. The spring fingers are formed integral with the base and are the same as described for FIG. 2 above.

The paint compartment is therefore defined by location of spring fingers 36, base portion 32*a*, and surrounding sidewall portions 34*a-b-c* providing an end closed by curved sidewall 34*a*, and an open end along line x-x' between sidewall portions 34*b-c*.

The tray further includes an integral brush compartment 35 defined by a base extension 32*b* from the paint compartment open end x-x', and by sidewall sections 34*d*, 34*e* and 34*f* extending beyond the open end. Sidewall sections 34*d-e-f* extend upward from the margin 32*c* of base 32*b*. Sidewall sections 34*d* and 34*f* each extend on both sides of the tray and are joined by section 35*e* to enclose the brush compartment. Sidewall sections 34*d* and 34*f* are each provided with two notches 34*g* for receiving the handles of larger and smaller brushes B placed in the brush compartment. It is a common practice to utilize two brushes, one large and one small, for worksite coverage and detailing so that the brush compartment receives one or both wet brushes as desired in completing a paint job.

The sidewall 34*a* of the holder includes an aperture 38 for holding the tray in one hand with the thumb extending through the aperture and the remaining fingers engaging the underside of the base.

As shown in FIG. 5, the tangential brush compartment 35 extends to the right (away from the aperture 38) as appropriate for right-hand use of the paint holder. For left hand use of the tray it is simply necessary to rotate the tray 180° placing the aperture at the right-hand.

The paint can and brush tray shown in FIG. 5 is particularly suited for use with quart and smaller size paint cans.

Figure 7:
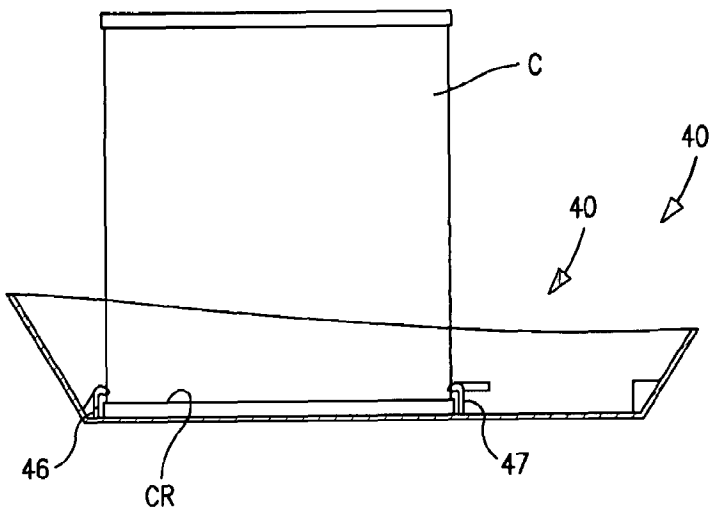
FIG. 7 is a side elevation view of the embodiment of FIG. 6.
Figure 6:
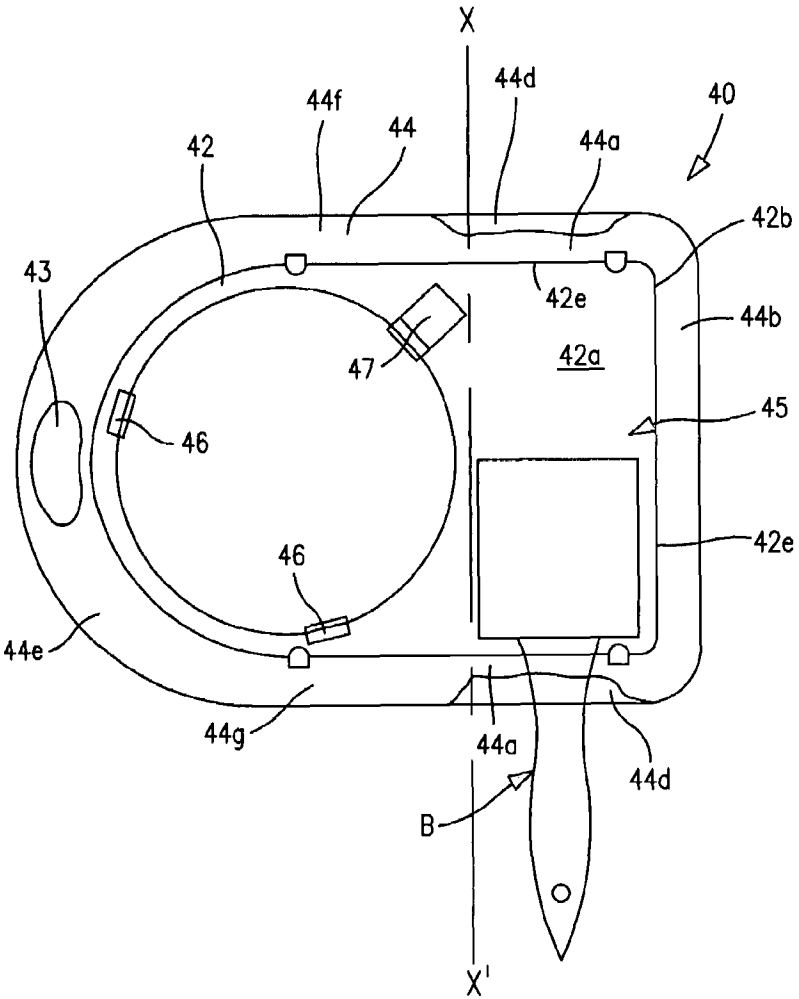
FIG. 6 is a plan view of another modified embodiment of the invention.

Another modified embodiment of the invention is shown in FIGS. 6 and 7 and comprises a tray 40 having a planar base 42 and upwardly inclined sidewall 44 and an aperture 43 for holding the tray in one hand with the thumb extending through the aperture and the remaining fingers engaging the underside of the base.

The tray further includes an integral brush compartment 45 defined by a base extension 42*a* and by peripheral sidewall sections 44*a*, 44*b* and 44*c* extending upward from the margin

42*b* of base 42*a*. Peripheral sidewall sections 44*a* and 44*c* each extend tangentially from the perimeter of the sidewall 44 on both sides of the tray. Peripheral sidewall sections 44*a* and 44*c* are joined by section 44*b* to enclose the brush compartment. Peripheral sidewall sections 44*a* and 44*c* are provided with notches 44*d* for receiving a brush handle.

The base of the tray is fitted with a plurality, preferably three or more, of upstanding tabs 46 and 47 arranged in a circle for engaging the bottom rim of a paint can for holding the can securely against the base. As shown in FIGS. 6 and 7, the tabs 46 and 47 engage the base rim $C_R$ of a paint can for securing the can in the tray. The tabs are formed integral with the base and are shown in detail in FIGS. 8*a*-8*c* and 9*a*-9*c*.

Fixed tabs 46 (FIGS. 8*a*-8*c*) rise from the base 42 in an upright post 46*a* terminating in a head 46*b* having an inwardly directed catch 46*c*. The inner surface 46*d* of the post and the underside 46*e* of the catch form a recess for engaging the can base rim $C_R$. A backing plate 46*f* supports the post against backward deflection.

Releasing tabs 48 (FIGS. 9*a*-9*c*) rise from the base 42 in a flexible upright post 48*a* terminating in a head 48*b* having an inwardly directed catch 48*c*. The inner surface 48*d* of the post and the underside 48*e* of the catch form a recess for engaging, the can base rim $C_R$. A releasing lever 48*f* extends horizontally to the backside of the head with the lever used for flexing the tab in a backward deflection to release a can base rim $C_R$. If desired lever surface can be ribbed to improve surface engagement by a thumb or other finger.

As best shown in FIG. 7, the tray receives and holds a paint can by its base rim under the catches 46*c* and 48*c* as the releasable tab deflects backward to receive the can and returns to upright position to hold the can in cooperation with fixed tabs 46.

The modified embodiment of FIGS. 6 and 7 provides a paint tray comprising a paint can compartment and a paint brush compartment.

The paint can compartment comprises that portion of the tray defined by closed curved end section 44*e* of the side wall, lateral side wall portions 44*f*-*g* flanking the paint can on opposite sides and in between having a having an open end of the paint compartment marked by line x-x'. The paint compartment is further defined by base 42 occupied by paint can C held in place by retaining tabs 46, 47.

The brush compartment is structurally and functionally distinct from the paint compartment being defined by sidewall sections 44*a*-*b*-*c* with sidewall sections 44*a*-*c* being extensions of sections 44*f*-*g*. The brush compartment is further defined by sidewall section 44*b* which joins sections 44*a*-*b* for a closed end of the brush compartment. The base 42*a* of the brush compartment is an extension of base 42 and connects along its perimeter to base margin 42*e* of sidewalls 44*a*-*b*-*c*. The brush compartment is wide enough to accommodate a paint brush wide side lying flat on base 42*a* as shown in FIG. 6.

Figure 8C:
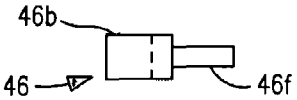
FIGS. 8*a*-8*c* are respectively detailed front and side elevation and plan views of a fixed catch tab of the embodiment of FIG. 6.
Figure 8B:
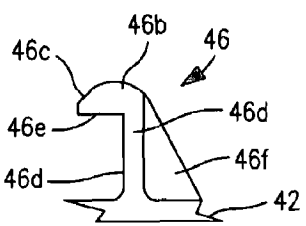
Figure 8A:
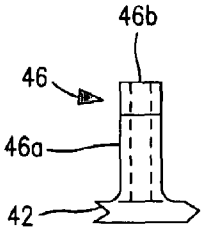
Figure 10:
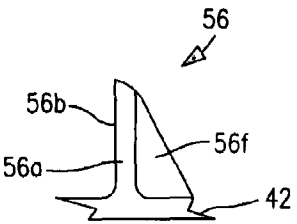
FIG. 10 is a side elevation of a modified form of the fixed catch tab of FIG. 8*b*.

FIG. 10 shows in side elevation a modified form of the fixed tab of FIG. 8*b* in which fixed tab 56 is an upright post 56*a* with the catch omitted. In this embodiment of the invention three or more fixed tabs 56 engage a can base rim to confine a can on the tray by means of engagement with the inner surface 56*b* of each tab.

Figure 9C:
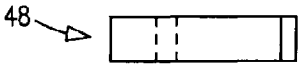
FIGS. 9*a*-9*c* are respectively detailed front and side elevation and plan views of a release catch tab of the embodiment of FIG. 6.
Figure 9B:
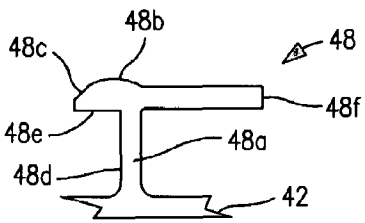
Figure 9A:
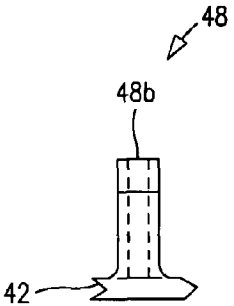
Figure 11:
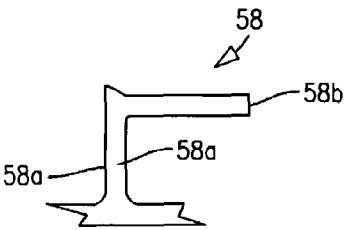
FIG. 11 is a side elevation of a modified form of the release catch tab of FIG. 9*b*.

FIG. 11 shows in side elevation a modified form of the releasable tab of FIG. 9*b* in which releasable tab 58 is an upright post 58*a* with the catch omitted and with releasing lever 58*b* extends horizontally to the backside of the post with the lever used for flexing the tab in a backward deflection to release a can base rim $C_R$. In this embodiment of the invention the releasable tad cooperates with two or more fixed tabs 56 (FIG. 10) engage a can base rim to confine a can on the tray by means of engagement with the inner surface 58*a* of each tab.

Figure 12:
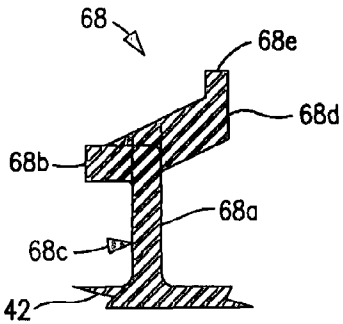
FIG. 12 is a side elevation of a modified form of release catch tab.

FIG. 12 illustrates a modified form of release tab 68 integral with tray base 42, and having a flexible upright post 68*a* terminating in a head with inwardly directed catch 68*b* cooperating with inner post surface 68*c* to retain a can base rim. A rearwardly directed lever 68*d* extends diagonally from the head and terminates in a vertical flange 68*e* for flexing the tab so as to release a can held by cooperating fixed and flexible tabs.

It is desirable to space retaining tabs a distance slightly greater than can diameter so as to guide a can into place amid the tabs.

Figure 13:
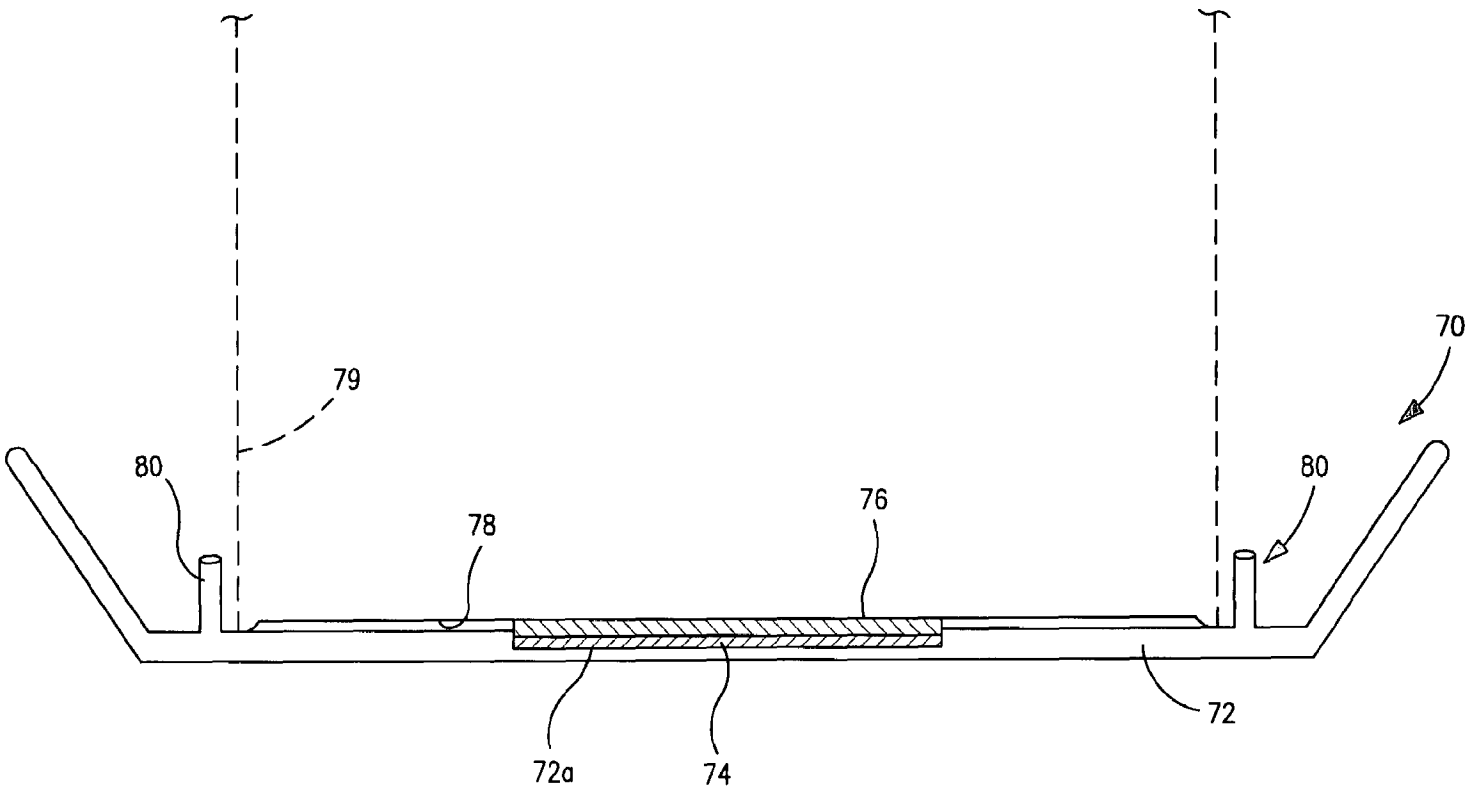
FIG. 13 is section view of a modified of paint tray according to the invention.

FIG. 13 illustrates a modified form of the invention in which a paint can and brush holder as shown and described in FIG. 1 above is modified for use with cans not having a base rim. In this form of the invention, a tray 70 with base 72 has a recess 72*a* in the base to receive a Velcro (hook and loop) fastener 74 affixed to the base in a suitable manner as by adhesive or being set in place as the tray is molded. A corresponding Velcro fastener 76 having the same dimensions as base fastener 74 is affixed to the base 78 of a can 79 by any suitable means such as adhesive. In this way a can with or without a base rim is secured to the tray. The tray is also fitted with a plurality, preferably four straight guide posts 80 made integral with the base for positioning a can on the base.

Figure 14:
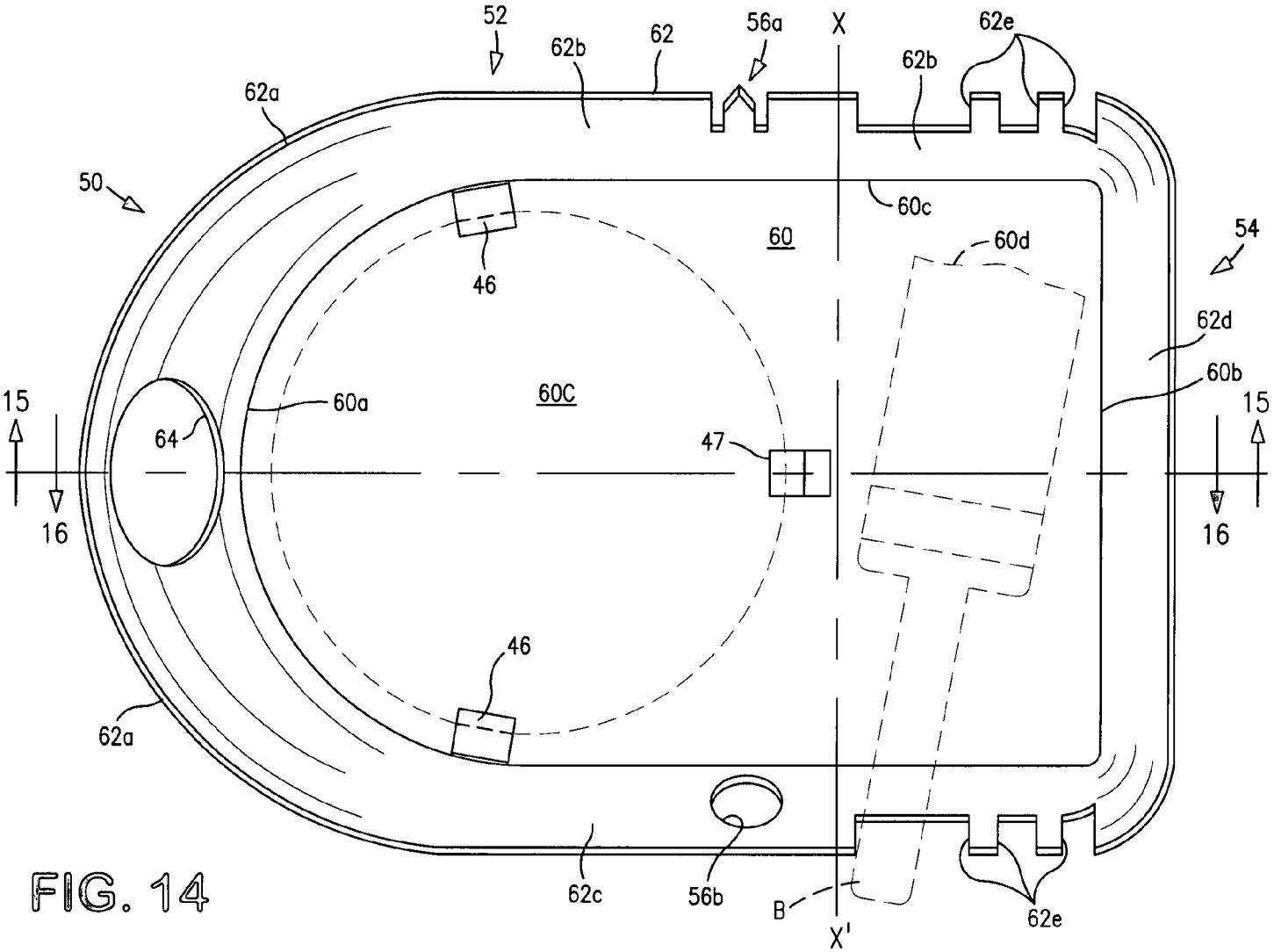
FIG. 14 is plan view of a modified of paint tray according to the invention.
Figure 15:
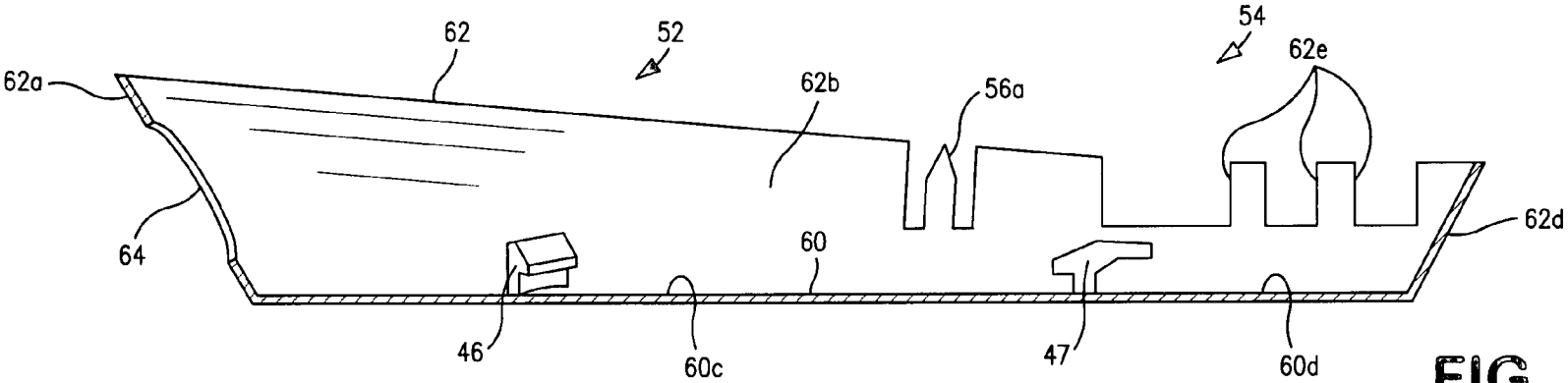
FIG. 15 is a section view taken along line 15-15 of FIG. 14.
Figure 16:
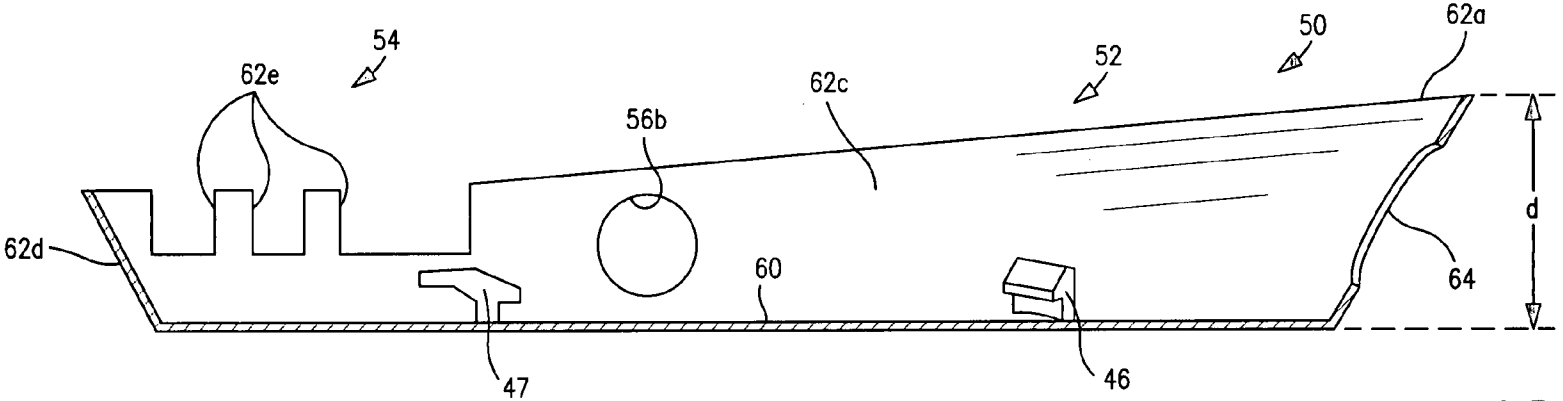
FIG. 16 is a section view taken along line 16-16 of FIG. 14.

FIGS. 14-16 illustrate a further modified embodiment of the invention comprising a paint tray 50 with paint can compartment 52, paint brush compartment 54, and means 56*a*-*b* for holding one or more wipe-up rags. Paint brush compartment and paint can compartment lie across nominal dividing line x-x'.

The tray 50 has a planar base 60 and upwardly and outwardly inclined sidewall 62 and an aperture 64 for holding the tray in one hand with the thumb extending through the aperture and the remaining fingers engaging the underside of the base.

The base 60 is a flat panel having a curved paint compartment end margin 60*a* and a linear brush compartment end margin 60*b* joined by side margins 60*c*-*d* extending tangentially from the curved margin to opposite ends of margin 60*b*.

A continuous, closed sidewall 62 is integral with and inclines upwardly and outwardly from margins of base panel for further defining the paint and brush compartments of the tray. The sidewall also rises toward its curved end to have a greater dimension d (FIG. 16) above the base so as to accommodate an aperture adequate in size for a painter's thumb. The upward incline of the curved end 62*a* of the sidewall also provides a natural fit and comfortable positioning of the tray in open hand of the painter. The sidewall further includes lateral sections 62*b*-*c* extending from the paint compartment to the end of the brush compartment and there joining the opposite ends of closed end wall section 62*d*. The lateral sections each have a series of notches 62*e* for accommodating the handle of a brush placed in the brush compartment. Lateral section 62*b* is fitted with a pointed blade 56*a* to which a wipe-up rag is attached when the tray is in use. Opposite lateral section 62*c* has an opening 56*b* for the same purpose, i.e., holding a wipe-up rag, an end of which is poked through the opening when the tray is in use.

The paint can compartment comprises that portion of the tray defined by closed curved end section 62*a* of the side wall, lateral sidewall portions 62*b*-*c* flanking the paint can on opposite sides and there-between between having a having an open end (or gap) of the paint compartment marked by line x-x'. The paint compartment is further defined by base 60*c* occupied by paint can C held in place by retaining tabs 46 and 47 which are the same as those shown and described in connection with FIGS. 8*a*-8*c* and 9*a*-9*c* as indicated by common reference numerals.

The brush compartment is structurally and functionally distinct from the adjoining paint compartment and is defined by lateral sidewall sections 62*b*-*c* and by end-wall section 62*d* at the closed end of the brush compartment. The base 60*d* of the brush compartment is an extension of base and connects along its perimeter to base margin of sidewalls. The brush compartment is wide enough to accommodate a paint brush B with wide side lying flat as shown in FIG. 14.

While the embodiments of the invention have been described with particular reference to paint, it is understood that the invention has application with containers in many sizes for other liquids where spills and dripping are encountered.

Various changes may be made to the structure embodying the principles of the invention. The foregoing embodiments are set forth in an illustrative and not in a limiting sense. The scope of the invention is defined by the claims appended hereto.

I claim:

1. A tray for a paint can and brush comprising a flat base panel, and an upwardly inclined sidewall integral with and extending about the periphery of the base, the tray being divided into a paint can compartment and a brush compartment, the paint can compartment being defined first by sections of sidewall situated around a paint can placed in the compartment, by a first portion of the base panel, and by means for holding a paint can to the first portion of the base panel, said first sections of side wall defining a gap separating the paint compartment from the brush compartment, the brush compartment adjoining the paint compartment across the gap and being defined by a second portion of said base panel, and further defined by second sidewall sections joined at the gap to said first sidewall sections and further joined by an end sidewall section, the second sidewall sections having at least one notch for receiving and supporting the handle portion of a paint brush placed in the brush compartment, the brush compartment having a width sufficient to accommodate a paint brush lying flat, and the first sections of sidewall having an aperture for receiving the thumb of a hand holding the tray and open paint can while the other hand applies paint from the can with a brush.

2. A tray as defined in claim 1 in which the brush compartment extends is on the opposite side of the tray from the thumb aperture so that the hands may optimally engage the tray in holding the tray and in applying paint.

3. A tray as defined in claim 1 in which the means for holding a paint can to the base comprises a plurality of spring fingers formed integral with the base, the fingers having an upright body having a side facing toward the center of the tray with the face defined by an upper cam surface and a lower recess, the spring fingers being arranged in a circle on the base so that when securing a paint can to the tray the base rim of the can engages the cam surface of the fingers pushing the fingers back and with the fingers springing back as the base rim fits into the recess of each finger thereby holding the can in place on the tray.

4. A tray as defined in claim 1 in which the means for holding a paint can having a base rim to the tray comprises a plurality of fixed tabs each having an upright post with an inner surface and a head with an inwardly directed catch having an under surface for confining the base rim of a can between the inner surface and the under surface, and a releasable tab having a flexible upright post with an inner surface and a head with an inwardly directed catch having an under surface for confining the base rim of a can between the inner surface and the under surface, the fixed tabs and the releasable tab cooperating to hold a can in the tray, the releasable tab further having a release lever for flexing the releasable tab to disengage a can base rim for removing a can from the tray.

5. A tray as defined in claim 4 in which the release lever extends diagonally from the releasable tab head and terminates in a vertical flange for flexing the release tab so as to release a can held by cooperating fixed and flexible tabs.

6. A tray as defined in claim 1 in which the means for holding the can to the base comprises a magnetic plate embedded in the base of the tray.

7. A tray as defined in claim 1 in which the means for holding a paint can to the base comprises a hook and loop fastener fitted to the base, and a hook and loop fastener fitted to the base of the paint can.

8. A tray as defined in claim 7 in which the base of the tray is fitted with a plurality of posts for guiding the can into position on the tray.

9. A tray for a paint can and brush comprising a flat base panel, and an upwardly inclined sidewall integral with and extending about the periphery of the base, the tray being divided into a paint can compartment and a brush compartment, the paint can compartment being defined by sections of sidewall curved around a paint can placed in the compartment, by a first portion of the base panel, and by means for holding a paint can to the first portion of the base, said sections of side wall defining a gap separating the paint compartment from the brush compartment, the brush compartment adjoining the paint compartment across the gap and being defined by a second portion of said base panel, and further defined by brush compartment sidewall sections joined at the gap to said paint compartment sidewall sections and further joined by a brush compartment end sidewall section, the brush compartment sidewall sections having at least one notch for receiving and supporting the handle portion of a wet brush placed in the brush compartment, the brush compartment having a width sufficient to accommodate a paint brush lying flat, the paint can compartment sidewall having an aperture for receiving the thumb of a hand holding the tray and open paint can while the other hand applies paint from the can with a brush, and the paint compartment side wall further having means for holding a wipe-up rag.

10. A tray as defined in claim 9 in which the means for holding a wipe-up rag comprises a tipped blade formed into the sidewall.

11. A tray as defined in claim 9 in which the means for holding a wipe-up rag comprises an opening through the sidewall.

12. A tray as defined in claim 9 in which the paint compartment increases in height as it curves around a paint can to achieve a sidewall dimension to accommodate the thumb aperture.

* * * * *